US012729895B2

(12) United States Patent
Bertelsen

(10) Patent No.: US 12,729,895 B2
(45) Date of Patent: Sep. 8, 2026

(54) REFRIGERATION SYSTEM WITH HEAT RECOVERY

(71) Applicant: Danfoss A/S, Nordborg (DK)

(72) Inventor: Preben Alfred Bertelsen, Silkeborg (DK)

(73) Assignee: DANFOSS A/S, Nordborg (DK)

( * ) Notice: Subject to any disclaimer, the term of this patent is extended or adjusted under 35 U.S.C. 154(b) by 155 days.

(21) Appl. No.: 18/748,338

(22) Filed: Jun. 20, 2024

(65) Prior Publication Data

US 2025/0003660 A1 Jan. 2, 2025

Related U.S. Application Data

(60) Provisional application No. 63/510,436, filed on Jun. 27, 2023.

(51) Int. Cl.

| | |
|---|---|
| ***F25B 41/20*** | (2021.01) |
| ***F25B 9/00*** | (2006.01) |
| ***F25B 49/02*** | (2006.01) |

(52) U.S. Cl.

CPC ..... *F25B 49/022* (2013.01); *F25B 9/008* (2013.01); *F25B 41/20* (2021.01)

(58) Field of Classification Search

CPC ..... F24F 5/0096; F24F 2221/183; F25B 7/00; F24H 4/00; F24H 4/02; F24H 4/04; F24D 3/18; F24D 17/0005; F24D 17/02; F24D 19/1054; F24D 19/1066; F24D 19/1069; F24D 19/1072

See application file for complete search history.

(56) References Cited

U.S. PATENT DOCUMENTS 5,826,433 A * 10/1998 Dube ..... F25B 41/20 62/131
10,502,461 B2 * 12/2019 Christensen ..... F25B 49/02

* cited by examiner

*Primary Examiner* — Jonathan Bradford
(74) *Attorney, Agent, or Firm* — McCormick, Paulding & Huber PLLC

(57) ABSTRACT

A refrigeration system with heat recovery includes a vapor compression circuit having at least one compressor, a gas cooler, a receiver, a first expansion device fluidly connected between a first refrigerant path of the gas cooler and the receiver, a second expansion device fluidly connected between the receiver and a second refrigerant path of the gas cooler, and at least one evaporator. The refrigeration system includes a heat exchanger configured to exchange heat between refrigerant flowing in the vapor compression circuit and a fluid flowing in a hot fluid circuit. The gas cooler is arranged such that heat from refrigerant flowing in the first refrigerant path of the gas cooler is transferred to refrigerant flowing in the second refrigerant path of the gas cooler when the second expansion device is open and allowing refrigerant flow from the receiver to the second refrigerant path of the gas cooler.

19 Claims, 1 Drawing Sheet
(1 of 1 Drawing Sheet(s) Filed in Color)

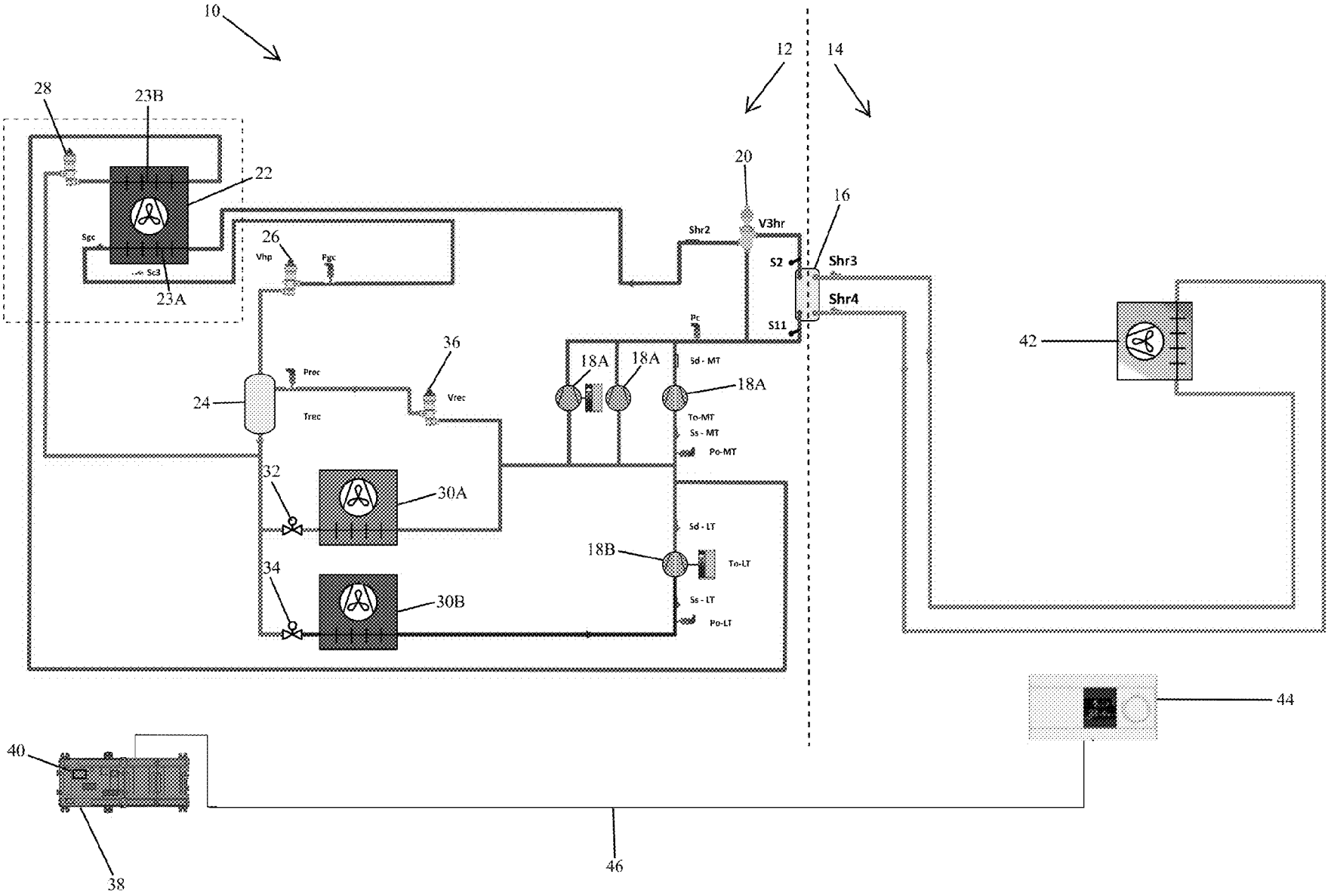
10
12
14
16
18A
18A
18A
18B
20
22
23A
23B
24
26
28
30A
30B
32
34
36
38
40
42
44
46
Shr3
Shr4
S2
S11
V3hr
Shr2
Ptc
Sd - MT
To-MT
Ss - MT
Po-MT
Sd - LT
To-LT
Ss - LT
Po-LT
Vrec
Prec
Trec
Fgk
Vhp
Sd
Sec

REFRIGERATION SYSTEM WITH HEAT RECOVERY

CROSS-REFERENCE TO RELATED APPLICATION

This application claims priority to U.S. Provisional Patent Application No. 63/510,436, filed Jun. 27, 2023, which is hereby incorporated by reference in its entirety.

TECHNICAL FIELD

The present disclosure relates to refrigeration systems with heat recovery apparatuses and methods of operating thereof and, more particularly, to refrigeration systems having carbon dioxide ($CO_2$) refrigerant with heat recovery for satisfying at least some of a heat demand for a hot fluid circuit with heat provided by a vapor compression circuit of the refrigeration system.

BACKGROUND

Refrigeration systems that provide heat to a hot fluid circuit are generally known. Such systems advantageously utilize heat obtained from a refrigeration process to satisfy a heat demand for the hot fluid circuit, thereby making efficient use of resources and energy. Operation of the refrigeration systems in cold climate areas and/or during colder seasonal times of the year sometimes results in the compressor(s) of the refrigeration system operating in a manner that does not provide sufficient heat to the hot fluid circuit to satisfy the heat demand.

SUMMARY

The present disclosure advantageously provides a refrigeration system with heat recovery of heat rejected from a gas cooler to reintroduce the heat into the refrigerant in a vapor compression circuit of the refrigeration system. The reintroduced heat is ultimately provided to a heat exchanger of the system for satisfying the heat demand of a hot fluid circuit. The heat obtained through the novel heat recovery apparatuses and methods of the present disclosure advantageously help satisfy the heat demand when the refrigeration system is operating in cooler temperatures when the compressor(s) is not operating at full or high capacity by reintroducing waste heat that would have been rejected by a gas cooler to an exterior environment.

According to some embodiments of the present disclosure a refrigeration system with heat recovery includes a vapor compression circuit having at least one compressor, a heat exchanger configured to exchange heat between refrigerant flowing in the vapor compression circuit and a fluid flowing in a hot fluid circuit, a valve configured to control a flow of refrigerant through the heat exchanger from the at least one compressor, a gas cooler having a first refrigerant path and a second refrigerant path, a receiver, a first expansion device fluidly connected between the first refrigerant path of the gas cooler and the receiver, a second expansion device fluidly connected between the receiver and the gas cooler, and at least one evaporator. The refrigeration system further includes a refrigeration controller configured to control the at least one compressor, the valve, the first expansion device and the second expansion device. The gas cooler is arranged such that heat from refrigerant flowing in the first refrigerant path of the gas cooler is transferred to refrigerant flowing in the second refrigerant path of the gas cooler when the second expansion device is open and allowing refrigerant flow from the receiver to the second refrigerant path of the gas cooler.

In some embodiments, a refrigeration controller for controlling a refrigeration system, comprises a processor configured to generate and send signals for controlling the at least one compressor, the valve, the first expansion device and the second expansion device.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 1 is a diagrammatic view of a refrigeration system with heat recovery for a hot fluid circuit according to the present disclosure.

DETAILED DESCRIPTION

Before various embodiments are described in further detail, it is to be understood that the invention is not limited to the particular embodiments described. It is also to be understood that the terminology used is for the purpose of describing particular embodiments only, and is not intended to limit the scope of the claims of the present application.

Referring to FIG. 1, a refrigeration system 10 is shown according to embodiments of the present disclosure. The system 10 includes a vapor compression circuit 12 with heat recovery for a hot fluid circuit 14 through a heat exchanger 16 of the vapor compression circuit configured to exchange heat between refrigerant flowing in the vapor compression circuit 12 and a fluid flowing in the hot fluid circuit 14.

The vapor compression circuit 12 includes at least one compressor 18, a three-way valve 20, a gas cooler 22, a receiver 24, a first expansion device 26 fluidly connected between a first refrigerant path 23A of the gas cooler 22 and the receiver 24, a second expansion device 28 fluidly connected between the receiver 24 and a second refrigerant path 23B of the gas cooler 22, and at least one evaporator 30.

The three-way valve 20 is configured to control the flow of refrigerant through the heat exchanger 16. In a first position of the three-way valve 20, refrigerant flow through the heat exchanger 16 from the output of the at least one compressor 18 is stopped and, thus, all of the refrigerant output of the at least one compressor 18 is directed to the gas cooler 22 without entering the heat exchanger 16. In a second position of the three-way valve 20, all of the refrigerant output of the at least one compressor 18 is directed to the heat exchanger 16 before ultimately flowing to the gas cooler 22.

In the embodiment shown in FIG. 1, the vapor compression circuit 12 includes three medium temperature compressors 18A and one low temperature compressor 18B. However, any number of compressors 18 are within the scope of the present disclosure, e.g. more or fewer medium temperature compressors 18A and/or more low temperature compressors 18B. Similarly, the shown embodiment includes two evaporators 30, but any number of evaporators 30 are within the scope of the present disclosure, e.g. more medium temperature evaporators and/or more low temperature evaporators. In some embodiments, there is only one evaporator 30 in the vapor compression circuit 12.

The vapor compression circuit 12 further includes a third expansion device 32 fluidly connected between the receiver 24 and the medium temperature evaporator 30A for controlling a flow of refrigerant from the receiver 24 through the evaporator 30A, and a fourth expansion device 34 fluidly connected between the receiver 24 and the low temperature evaporator 30B for controlling a flow of refrigerant from the receiver 24 through the evaporator 30B. A gas bypass valve 36 is arranged fluidly connected between the receiver 24 and the at least one compressor 18 for providing refrigerant bypass of the evaporators 30 as needed or desired.

The vapor compression circuit 12 further includes one or more pressure sensors and/or one or more temperature sensors for detecting pressure and/or temperature at various points in the circuit (and/or other sensor types, e.g. flow sensors, etc.). The pressure sensor and temperature sensor data (and/or other data) is provided to a refrigeration controller 38 (an electronic controller) through wired and/or wireless communication channels. The refrigeration controller 38 includes a processor 40 configured to receive the pressure sensor and/or temperature sensor data.

The hot fluid circuit 14 includes at least one hot fluid load 42. The hot fluid load 42 receives heat from the hot fluid (e.g. water) flowing in the hot fluid circuit. The fluid leaving the hot fluid load 42 is cooler than the hot fluid entering the hot fluid load 42 and is returned to the heat exchanger 16 for receiving heat from the vapor compression circuit 12.

A hot fluid controller 44 (an electronic controller) is configured to receive one or more parameters of the hot fluid circuit 14 for determining a hot fluid demand required by the at least one hot fluid load 42. While not shown, the hot fluid circuit 14 may include one or more sensors (e.g. pressure, temperature, flow rate, etc.) for determining the status of one or more points in the hot fluid circuit 14. The sensor data is provided from the sensor(s) to a hot fluid controller 44 through wired and/or wireless means. Based on the sensor data, the hot fluid controller 44 generates and sends a hot fluid demand signal 46 to the refrigeration controller 38. The hot fluid demand signal 46 may be sent through wired or wireless channels. In some embodiments, the heat demand signal 46 may be a voltage signal and the magnitude of the voltage signal indicates a level of heat level demand. For example and without limitation, the heat demand signal 46 may be a voltage signal in the range of 0-10 volts for indicating various levels of heat demand. However, other voltage ranges are within the scope of the present disclosure.

In operation, the refrigeration controller 38 is configured to perform a heat recovery method according to a heat demand signal action in accordance with the following table:

HEAT RECOVERY TABLE

| Heat Demand Signal | Refrigeration Controller Action |
|---|---|
| No Heat Demand (e.g. 0 volts, or <0.3 volts) | Control the three-way valve 20 to stop refrigerant flow in the heat exchanger 16 |
| First Level Heat Demand (e.g. 0.3-0.5 volts) | Control the three-way valve 20 to allow refrigerant flow through heat exchanger 16 |
| Second Level Heat Demand (e.g. 1-8.5 volts) | Control the first expansion device 26 to increase pressure in the first refrigerant path 23A of gas cooler 22 (e.g. 50 bar to 80 bar at sensor Pgc, by closing or reducing opening degree of first expansion device 26) |
| Third Level Heat Demand (e.g. 9.5-10 volts) | Control second expansion device 28 to open to allow refrigerant flow from receiver 24 through second refrigerant path 23B of gas cooler 22 |

In the above-described heat recovery table, each successive level of heat demand is greater than the previous level of heat demand. In some embodiments, the refrigeration controller 38 action for each level of heat demand includes all of the actions for previous level. For example, when the third level of heat demand is indicated by a heat demand signal 46 with, for example, 9.7 volts, the refrigeration controller 38 is configured to perform all of the actions of the first, second and third levels of heat demand shown in the heat recovery table. In some embodiments, the heat recovery table may be stored as instructions in a memory associated with the processor 40 or in a non-volatile computer readable memory accessible by the processor 40.

In some embodiments, the refrigeration controller 38 is configured to control the opening degree of the second expansion device 28 based on a magnitude of the voltage signal of the heat demand signal 46. For example and without limitation, the refrigeration controller 38 may be configured to control the opening degree of the second expansion device 28 as follows: 20% open when heat demand signal is 9.6 volts; 40% open when heat demand signal is 9.7 volts; 60% open when heat demand signal is 9.8 volts; 80% open when heat demand signal is 9.9 volts; and 100% open when heat demand signal is 10.0 volts.

The opening degree of the second expansion device 28 determines the flow and expansion of refrigerant flowing through the second refrigerant path 23B of the gas cooler 22, which determines the amount of heat ultimately reintroduced back into the vapor compression circuit 12 before being returned to the at least one compressor 18, and then the heat exchanger 16. Heat transfer in the gas cooler 22 generally works such that hot refrigerant in the first refrigerant path 23A transfers heat to air which passes over the second refrigerant path 23B thereby transferring at least some of the heat to the cooler refrigerant flowing therein. Advantageously, this heat recovery mechanism reintroduces heat to the refrigerant in the vapor compression circuit 12 that otherwise would have been rejected to an exterior environment. The refrigerant carrying the reintroduced heat is directed to the at least one compressor 18 before delivering the heat to the hot fluid circuit 14 via the heat exchanger 16.

While only three levels of heat demand are described, it is within the scope of the present disclosure for the refrigeration controller to perform heat recovery methods with any number of levels of heat demand. For example, in some embodiments, there is only one level of heat demand or two levels of heat demand and one or more of the refrigeration controller 38 actions are combined or not performed (e.g. avoiding increasing pressure in the first refrigerant path 23A of gas cooler 22 associated with second level of heat demand). In some embodiments, there are more than three levels of heat demand and the refrigeration controller 38 is configured to perform other actions for satisfying heat demand of the hot fluid circuit 14.

As will be recognized by those of ordinary skill in the pertinent art, numerous changes and modifications may be made to the above-described embodiments of the present disclosure without departing from the spirit of the invention as defined in the appended claims. Accordingly, the particular embodiments described are to be taken merely as illustrative and not limiting.

What is claimed is:

1. A refrigeration system with heat recovery comprising:

a vapor compression circuit comprising:

at least one compressor;

a heat exchanger configured to exchange heat between refrigerant flowing in the vapor compression circuit and a fluid flowing in a hot fluid circuit;

a valve configured to control a flow of refrigerant through the heat exchanger from the at least one compressor;

a gas cooler having a first refrigerant path and a second refrigerant path;

a receiver;

a first expansion device fluidly connected between the first refrigerant path of the gas cooler and the receiver;

a second expansion device fluidly connected between the receiver and the gas cooler; and at least one evaporator;

a refrigeration controller configured to control the at least one compressor, the valve, the first expansion device and the second expansion device;

wherein the gas cooler is arranged such that heat from refrigerant flowing in the first refrigerant path of the gas cooler is transferred to refrigerant flowing in the second refrigerant path of the gas cooler when the second expansion device is open and allowing refrigerant flow from the receiver to the second refrigerant path of the gas cooler.

2. The refrigeration system according to claim 1, wherein the refrigerant in the vapor compression circuit comprises carbon dioxide.

3. The refrigeration system according to claim 1, wherein the at least one compressor comprises two or more compressors.

4. The refrigeration system according to claim 1, wherein the at least one compressor comprises a medium temperature compressor and a low temperature compressor.

5. The refrigeration system according to claim 1, wherein the at least one evaporator comprises two or more evaporators.

6. The refrigeration system according to claim 1, wherein the at least one evaporator comprises a medium temperature evaporator and a low temperature evaporator.

7. The refrigeration system according to claim 6, further comprising:

a third expansion device fluidly connected between the receiver and the medium temperature evaporator; and a fourth expansion device fluidly connected between the receiver and the low temperature evaporator;

wherein the controller is configured to control the third expansion device and the fourth expansion device.

8. The refrigeration system according to claim 1, wherein the valve is a three-way valve.

9. The refrigeration system according to claim 1, wherein the refrigeration controller is configured to control the valve, the first expansion device and/or the second expansion device based on a level of heat demand in a heat demand signal received by the refrigeration controller.

10. The refrigeration system according to claim 9, wherein, when the level of heat demand is a first level, the refrigeration controller is configured to control the valve to move from a first position where no refrigerant is flowing through the heat exchanger to a second position where refrigerant is flowing through the heat exchanger while the at least one compressor is operating.

11. The refrigeration system according to claim 10, wherein, when the level of heat demand is a second level, the refrigeration controller is configured to control the first expansion device to increase pressure in the first refrigerant path of the gas cooler by closing the first expansion device or reducing an opening degree of the first expansion device.

12. The refrigeration system according to claim 11, wherein, when the level of heat demand is a third level, the refrigeration controller is configured to control the second expansion device to open, thereby allowing refrigerant to flow from the receiver to the second refrigerant path of the gas cooler.

13. The refrigeration system according to claim 1, wherein the refrigeration controller is configured to variably open the second expansion device based on a level of heat demand of a heat demand signal received by the refrigeration controller.

14. A refrigeration controller for controlling a refrigeration system, the refrigeration system including:

a vapor compression circuit that includes:

at least one compressor;

a heat exchanger configured to exchange heat between refrigerant flowing in the vapor compression circuit and a fluid flowing in a hot fluid circuit;

a valve configured to control a flow of refrigerant through the heat exchanger from the at least one compressor;

a gas cooler having a first refrigerant path and a second refrigerant path;

a receiver;

a first expansion device fluidly connected between the first refrigerant path of the gas cooler and the receiver;

a second expansion device fluidly connected between the receiver and the gas cooler; and at least one evaporator;

wherein the gas cooler is arranged such that heat from refrigerant flowing in the first refrigerant path of the gas cooler is transferred to refrigerant flowing in the second refrigerant path of the gas cooler when the second expansion device is open and allowing refrigerant flow from the receiver to the second refrigerant path of the gas cooler;

the refrigeration controller comprising:

a processor configured to generate and send signals for controlling the at least one compressor, the valve, the first expansion device and the second expansion device.

15. The refrigeration controller according to claim 14, wherein the processor is configured to control the valve, the first expansion device and/or the second expansion device based on a level of heat demand in a heat demand signal received by the refrigeration controller.

16. The refrigeration controller according to claim 15, wherein, when the level of heat demand is a first level, the processor is configured to control the valve to move from a first position where no refrigerant is flowing through the heat exchanger to a second position where refrigerant is flowing through the heat exchanger while the at least one compressor is operating.

17. The refrigeration controller according to claim 16, wherein, when the level of heat demand is a second level, the processor is configured to control the first expansion device to increase pressure in the first refrigerant path of the gas cooler by closing the first expansion device or reducing an opening degree of the first expansion device.

18. The refrigeration controller according to claim 17, wherein, when the level of heat demand is a third level, the processor is configured to control the second expansion device to open, thereby allowing refrigerant to flow from the receiver to the second refrigerant path of the gas cooler.

19. The refrigeration controller according to claim 14, wherein the processor is configured to variably open the second expansion device based on a level of heat demand of a heat demand signal received by the refrigeration controller.

* * * * *